United States Patent [19]

Osika

[11] Patent Number: 4,463,228

[45] Date of Patent: Jul. 31, 1984

[54] PORTABLE ELECTRICAL SWITCH AND OUTLET UNIT

[75] Inventor: Thomas F. Osika, Valparaiso, Ind.

[73] Assignee: McGill Manufacturing Company, Inc., Valparaiso, Ind.

[21] Appl. No.: 456,367

[22] Filed: Jan. 7, 1983

[51] Int. Cl.[3] ..... H01R 13/70

[52] U.S. Cl. ..... 200/51 R; 200/42 T

[58] Field of Search ..... 200/42 R, 42 T, 44, 200/51 R, 260

[56] References Cited

U.S. PATENT DOCUMENTS

| | | | |
|---|---|---|---|
| 2,474,454 | 6/1949 | Avery | 200/51 LM |
| 2,784,268 | 3/1957 | Shepherd | 200/51 LM |
| 2,907,855 | 10/1959 | Hedges | 200/51 R |
| 3,163,728 | 12/1964 | Martin | 200/51 R |
| 3,415,966 | 12/1968 | Matthews | 200/157 |
| 3,524,029 | 8/1970 | Laff | 200/51 R |
| 3,678,229 | 7/1972 | Osika | 200/42 T |
| 4,000,383 | 12/1976 | Lockard | 200/339 |
| 4,107,484 | 8/1978 | Petersen | 200/42 T |

*Primary Examiner*—John W. Shepperd

*Attorney, Agent, or Firm*—Foorman L. Mueller

[57] ABSTRACT

A portable electrical circuit control unit with a key-lockable switch means assembled on a molded base member of insulating material with said unit including an electrical receptacle or outlet for receiving the plug on a conductor from a motor and also including an extension cord for connection to a source of electricity all on said base member which is covered by a molded member of insulating material to house that which is assembled on said base member and cooperate in maintaining the same on said base member, with said switch means including bridging contact means in continuous electrical connection with the receptacle or outlet and selectively operable to electrically connect with said extension cord and complete a circuit to said receptacle or outlet, said switch means including a removable key to disable said latter means.

3 Claims, 9 Drawing Figures

FIG. 1
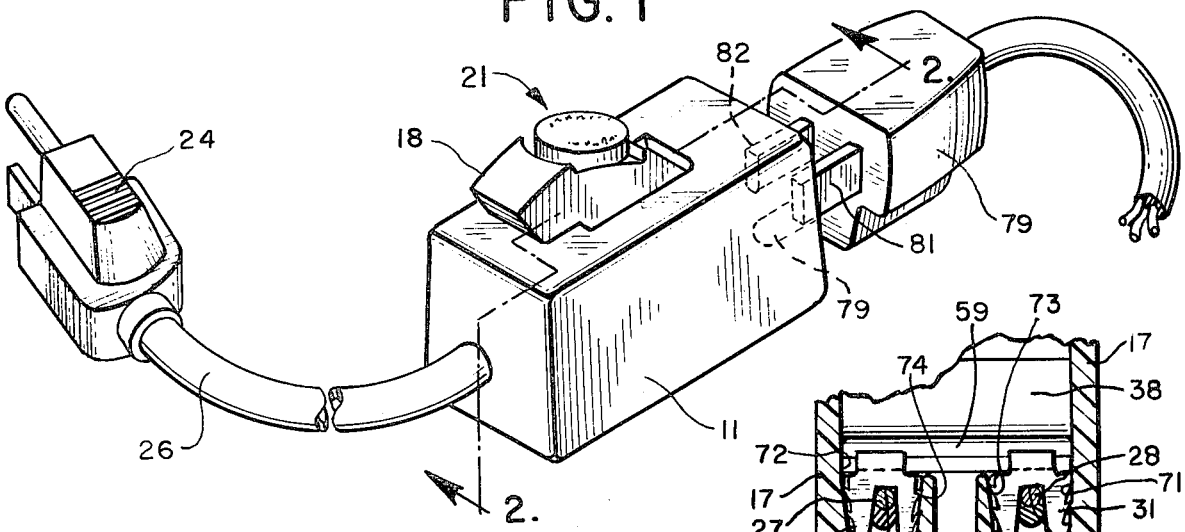
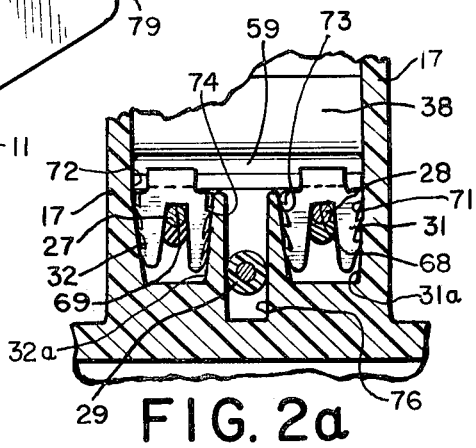
FIG. 2a
FIG. 2
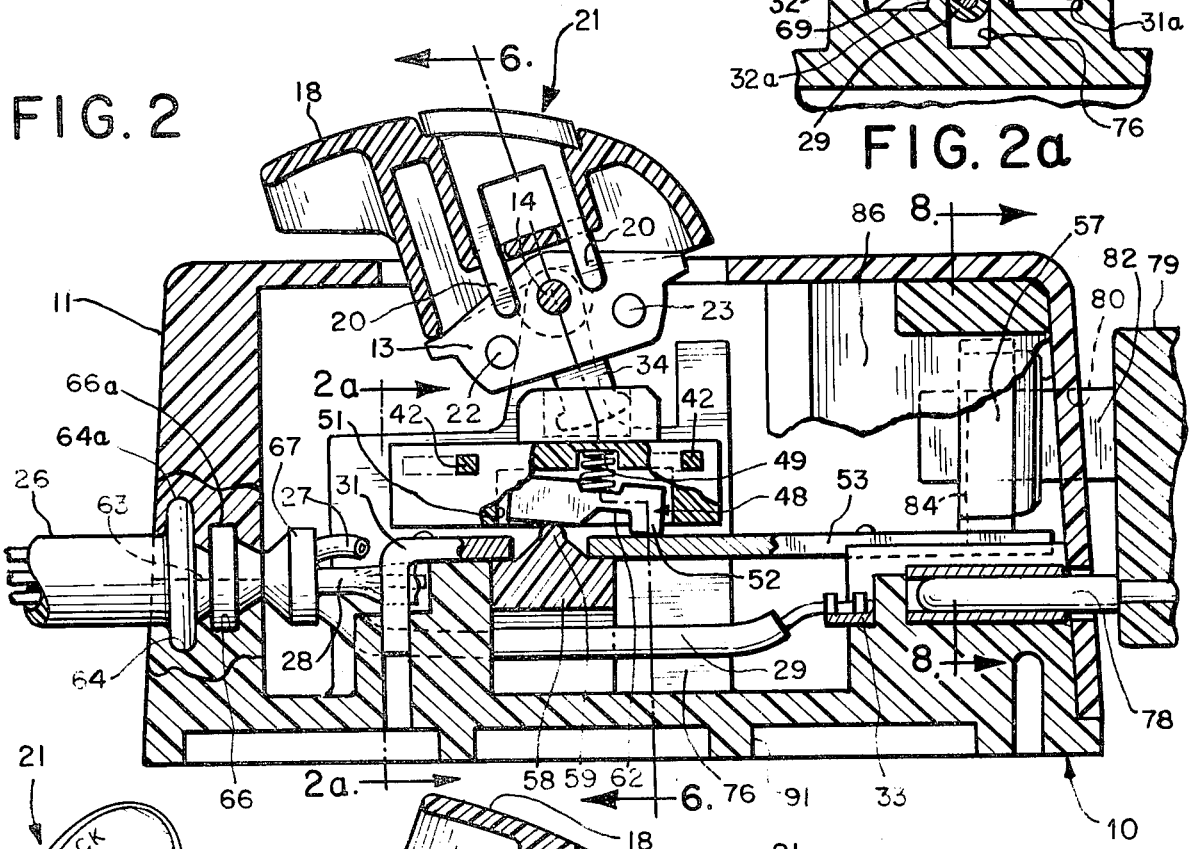
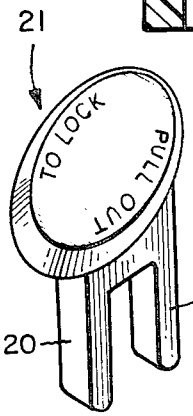
FIG. 3
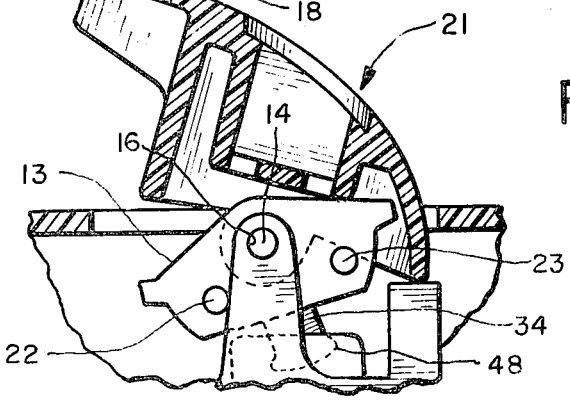
FIG. 4

PORTABLE ELECTRICAL SWITCH AND OUTLET UNIT

BACKGROUND AND SUMMARY OF THE INVENTION

As safety consciousness in the use of electrical tools has increased over the years key-operated electrical switches have performed an important function by disabling the switch that controls the motor circuit to drive such a tool while the key is removed from the switch. The rocker type key-operated switch of the present applicant's U.S. Pat. No. 3,632,914 issued Jan. 4, 1972, and owned by the assignee of the present invention and application has played a significant commercial role in that respect. Other U.S. patents to the present applicant and to said assignee on rocker type key-operated switches are U.S. Pat. No. 3,678,229 issued July 18, 1972, and U.S. No. 4,230,917 issued Oct. 28, 1980. The switch of each such patent is normally mounted on the tool itself or on equipment for the tool and connected with the motor driving such tool for control of that motor circuit. However, there has also been a need for such a switch for motor driven electrical equipments that do not have this lockable protection, and might even need a portable switch for simply controlling the motor circuit, or for both operating the motor circuit and locking the switch against such operation therewith, as though such a switch had been originally provided with the equipment. That need is provided in the present invention as a portable electrical switch unit adapted for ready mounting in many places in connection with the equipment to be served, connectible by an extension cord to a source of electricity and having an electrical outlet therewith controlled by such switch into which the motor for the tool can be plugged and thereby energized with the switch in "On" position and disabled in "Off" position with the key removed.

It is an object of this invention to provide a sturdy and low cost portable unit having a rocker type key-operated switch therewith, an outlet with said unit electrically connected to and controlled by said switch to accommodate the cord and plug from the motor operating a tool, and an extension cord with said unit that is also electrically connected to said switch for connection in turn to an electrical source for the purpose of providing a circuit at said outlet controlled through said switch.

A further object is to provide such a portable unit wherein the elements of a switch and the elements of an electrical outlet for the unit are mounted on and utilize the structure of a molded base of insulating material covered by a member of insulating material which also cooperates in the assembly of the switch and the electrical outlet on such base and the handling and use of such portable unit, as well as completing a housing with said molded base.

A feature of the portable unit of this invention is that an extension cord positively gripped by and maintained in the assembled insulating base and cover members for such unit can be plugged into a so-called hot or live electrical outlet, and through an electrical key-lockable switch in the unit an outlet or receptacle likewise mounted and maintained in the housed structure can be turned on or off depending upon the position of the switch. When the switch is in off position with the key removed no unauthorized person can energize the outlet or receptacle in the unit, nor can the circuit through such outlet be turned on inadvertently, thus providing maximum protection against an improper turning on of a tool connected into such outlet of the portable unit.

The actuating structure for the switch includes a carrier and a rocker each pivotally mounted on the base with a common axis and pivotable independently of one another when unlocked and pivotable together when they are connected by the key, corresponding to such structure shown and described in the U.S. Pat. No. 3,632,914 which is cross-referenced herein for such structure and operation. In order to provide a sturdy and low cost housing for the complete switch and the complete outlet or receptable portion, the unit has a molded base of insulating material supporting stationary electrical contacts for the switch and for stationary receptable tabs in the outlet to receive the blades of a plug to be connected into such outlet in the usual manner to supply electricity for a motor. The wires for the extension cord for the portable unit are positioned in passageways or channels molded in such base, and the cord is gripped and maintained in position as it enters the base area by corresponding half or approximately half apertures and projections having the resiliency of the molded material. Barriers are also provided in the molded cover which fit into position around the receptacle contacts for the outlet and support such contacts as the blades of a plug are inserted therein.

A bridging contact for the switch moves logitudinally and slidingly on stationary contacts which are maintained on the molded insulating material base when the carrier and rocker of the switch are connected and movable into "On" or "Off" positions for corresponding operativeness or inoperativeness of the circuit to said outlet or receptacle in the unit.

DESCRIPTION OF THE DRAWINGS

FIG. 1 is a perspective view of the entire portable unit of this invention including an extension cord therewith and also showing a plug with a cord attached inserted into the electrical outlet of the unit from a motor or the like to be electrically energized;

FIG. 2 is an enlarged side view partly in section of the entire base member and cover member along the line 2—2 of FIG. 1 as well as the line 2—2 of FIG. 6 with the switch in "Off" position and the lock key in place, and including a portion of the extension cord for the unit and a plug from an electric motor in the outlet of the unit;

FIG. 2*a* is a fragmentary cross-sectional view along the line 2*a*—2*a* in FIG. 2, and looking in the direction of the arrows there shown;

FIG. 3 is a perspective of the locking key;

FIG. 4 is a fragmentary portion partly in cross-section of the rocker member, the carrier member and the pivotal support therefor with the locking key removed whereby such two members are pivotal relative to one another;

DETAILED DESCRIPTION

The principal portion of the complete portable unit comprises a molded plastic base 10 of insulating material with a resiliency such that the base and a molded insulating cover 1 (FIG. 6), as will be hereinafter fully described, can be brought together to complete the assembly and resiliently locked. Such base 10 corresponding in area to the opening 12 (FIG. 6) at the bottom of said cover 11 supports thereon the elements of a switching mechanism, an outlet or receptacle for receiving the blades of a plug from a motor, and for receiving the end portion of an extension cord for the portable unit as can be understood from FIGS. 1 and 2 in particular.

Figure 5:
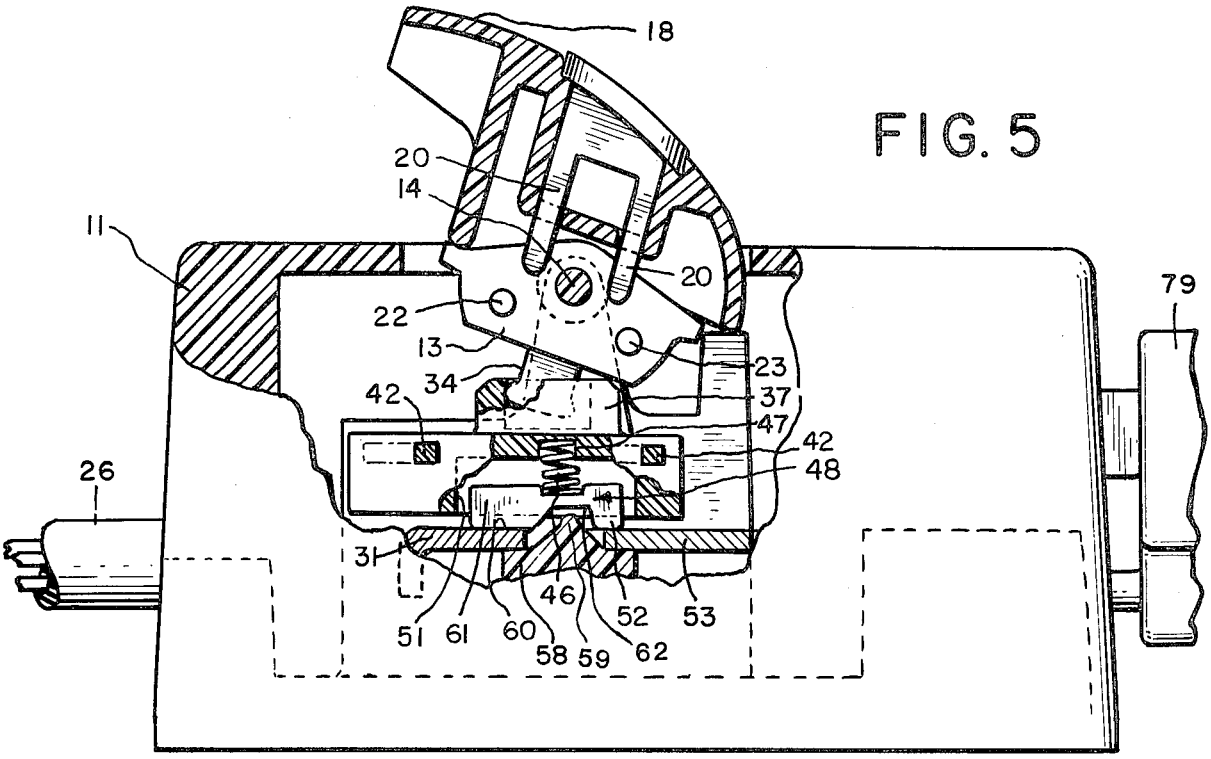
FIG. 5 is an enlarged view of the housed unit with a portion of the cover broken away to show the switch mechanism in cross-section with the switch in "On" position and the key inserted in such switch.

Referring first to the electrical switching mechanism as shown most fully in FIGS. 2 and 5, this comprises a molded carrier 13 pivotally mounted on pin or axle portions 14 integral with the carrier and snapped into apertures 16 (FIG. 6) in supports 17 integral with such base 10. The rocker or actuator 18 in turn is pivotally mounted on pin or axle portions (14A of carrier 13) which snap into a corresponding aperture 15 of actuator 18 in the axis line for such carrier so that such rocker and carrier can pivot independently of one another, or can pivot together on the same axis when connected by the key 21, in the manner of the carrier and rocker, with the key out or in as in U.S. Pat. No. 3,632,914. The three elements as described are shown with the switch in "Off" position in FIG. 2 and in "On" position in FIG. 5. In FIG. 4, the carrier 13 is shown in "Off" position for the switch, and with the key 21 removed, the rocker 18 has pivotted independently of the carrier 13. The switch is in "On" position in FIG. 5, with the key in position and having the rocker, the carrier and the bridging contact to move to such "On" position. In that respect it is noted that stops 22 and 23 molded integral on the side of the carrier 13 engage the supports 17 to limit the extent of the pivotal movement of such carrier at the "Off" and the "On" positions. The key 21 gas two legs 20 that effect the connection between rocker and carrier exactly as disclosed in U.S. Pat. No. 3,632,914.

Figure 6:
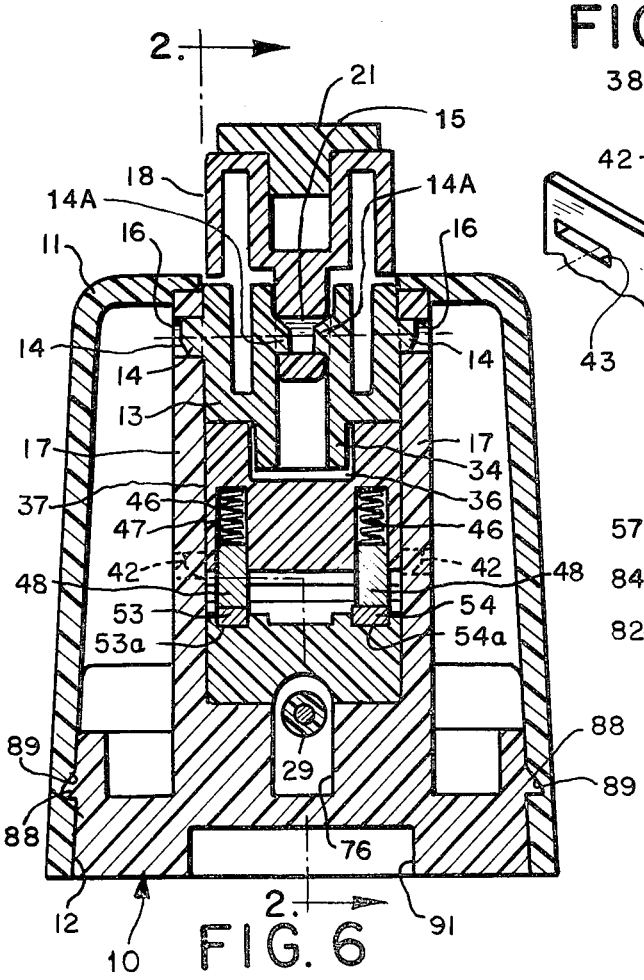
FIG. 6 is a cross-sectional view along the line 6—6 of FIG. 2.
Figure 7:
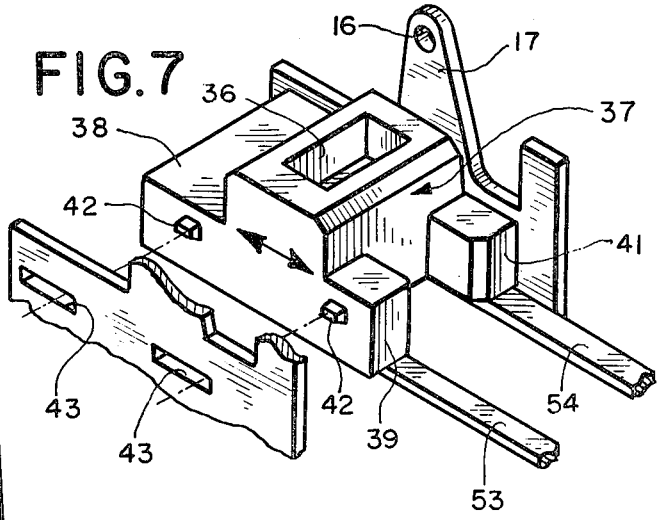
FIG. 7 is an enlarged perspective with portions broken away showing details of the slidable carriage for the switch bridging contact.

The circuit through the switch in "On" position to the outlet in the unit is made through the plug 24 (FIG. 1) connected into a live outlet, and the extension cord 26 comprising three wires 27, 28 and 29, the first two connected to stationary contacts 31 and 32 (FIGS. 2 and 2*a*), and the third wire 29 connected to a ground terminal 33 in the outlet at the right end portion of the base 10, as shown in FIG. 2. In addition to the elements of the switching mechanism previously described, such mechanism also includes an extension 34 on the carrier 13 which fits into a recess 36 of a molded carriage 37 (FIG. 7) having integral leg portions 38, 39 and 41. Such carriage is movable longitudinally guided by knobs 42 on the sides thereof slidable in corresponding slots 43 which are each of a length permitting complete slidable movement of the carriage. Coiled springs 46 of music wire are maintained in recesses 47 of such carriage 37 bearing down on bridging contact means comprising separated copper contacts 48 seated in respective recesses 49 in the top of such contacts 48 (FIGS. 2,6).

Such bridging contact means comprising said contacts 48, as shown in its two positions in FIGS. 2 and 5, is maintained within a recess 51 in the carriage 37 with one end portion 52 (FIG. 2) of each in physical and electrical engagement with the respective two stationary contacts 53 and 54 which in turn are either integral with or in electrical connection respectively with U-shaped receptacle tabs or contacts 56 and 57 (FIG. 8) for the electrical outlet in the unit of this invention. When the rocker and carriage are moved to the "On" position of FIG. 5 the two bridging contact members 48 are slidable longitudinally, riding over a molded phenolic insert 58 acting as a cam at the hump 59 thereof. The bridging contact members slide over such hump 59 and the other end portion 61 of each drops onto the respective stationary contacts 31 and 32 as a result of a cross-recess 62 accommodating such hump as shown in FIG. 5, while the one end portion 52 of each is in engagement with the stationary contacts 53 and 54. The under surface or contact face 60 of each bridging contact 48 slides on the respective stationary contacts 53 and 54 and the cam or hump 59 maintains the same in a clean electrical contact condition. All such contacts in brass perform satisfactorily in making an electrical connection from the extension cord 26 through the contacts 31 and 32, the two copper bridging contacts 48, and the contacts 53 and 54 to the outlet structure at the right end of the base and cover as looking at such housed device in FIGS. 1, 2, and 5. In opening such circuit to such outlet in the portable unit, the reverse action takes place with the rocker 18 having the key 21 in place moved to the position of FIG. 2 with the bridging contact members 48 riding over the hump 59 which precipitively break the electrical connection with the respective contacts 31 and 32.

The key 21 can be withdrawn with the bridging contact means in "Off" position. The carriage 13 and rocker 18 are then pivotal independently of one another as shown in FIG. 4, and movement of the rocker 18 does not move the carriage 13 or the bridging contact members 48 in such means.

Referring more specifically to the molded base 10 of insulating material and the corresponding molded cover 11 of insulating material, such base includes a one-half aperture 63 (FIG. 2) with corresponding grooves 64 and 66 to accommodate the insulating covering of the extension cord 26 along with an extension 67 from which the three insulated conductors 27, 28 and 29 protrude with the conductor 29 connected to the ground terminal 33 in the outlet as previously described and the conductors 27 and 28 connected to the stationary contacts 32 and 31 respectively. As shown in FIG. 2*a* the downwardly extending or right-angled end portion of the contact 31 has a cutting portion 68 that cuts through the insulation on the conductor 28 and makes contact with wire itself in such conductor, as does the corresponding cutting portion 69 on the stationary contact 32. Each of the two end cutting portions 68 and 69 are positioned in respective channels 71 and 72 in the base, and spikes 73 and 74 on the outside edges of the end portions respectively wedge into the respective channels 71 and 72 or grooves as the cutting of the insulation is accomplished. Thus, each stationary contact 31 and 32 is maintained in position in the base 10, the conductors 27 and 28 in the extension cord 26 are electrically connected to the stationary contacts 32 and 31, and such extension cord 26 is held fast by the base 10 and cover 11 at the aperture 63 with corresponding portions 64 and 64*a* and 66 and 66*a* at such aperture firmly gripping and maintaining fixed therein the insulation of the extension cord 26 and hence the entire cord itself with conductors 27, 28 and 29 therein. The ground conductor 29 is positioned in a groove or channel 76 (FIGS. 2 and 6), and the ground connection 33 in the outlet is wedged into a channel 77 (FIG. 8) in such base so as to stay fixed when a ground contact on a plug 79 is inserted into the connection 33. Upon such insertion blades 81 and 82 on such plug 79 are inserted into the stationary receptacle contacts 56 and 57 in the complete outlet through the cover 11.

Figure 8:
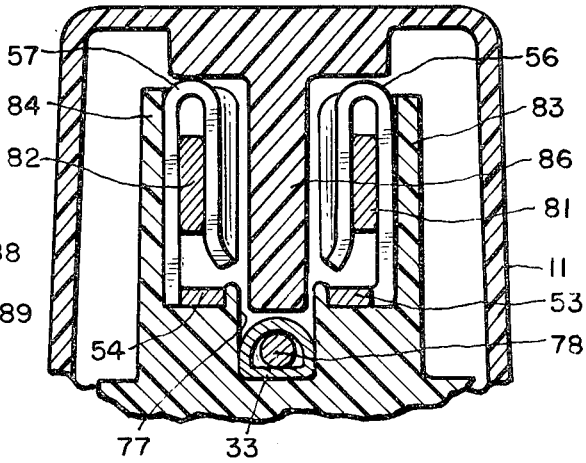
FIG. 8 is a fragmentary partly sectional view of the outlet or receptacle contact tabs along the line 8—8 of FIG. 2.

In the illustrated embodiment of the invention the stationary contacts 53 and 54 are integral with the U-shaped resilient receptacle contacts 56 and 57 respectively, but each stationary contact may be mechanically and electrically connected to a corresponding receptacle contact as well as integral. Upstanding insulating portions 83 and 84 are molded integral with the base member and spaced apart as shown in FIG. 8 to support the corresponding receptacle contacts 56 and 57 as the plug 79 is inserted through opening 80 in the cover 11 into the bevelled openings of such contacts 56 and 57. The space between the contacts 56 and 57 is maintained and they are completely electrically insulated from one another by a projection 86 molded integral with the cover 11 as shown in FIG. 8 which is pressed into position as such cover and base are brought together and locked. This locking is accomplished by a plurality of projections 88 in the base 10 (FIG. 6) snapping into corresponding recesses 89 in the cover. As shown in FIGS. 2 and 6 there are recesses 91 molded in the base member 10 to reduce the molded insulating material needed and thus reduce the weight of such member.

As has been described and illustrated herein, a portable extension cord and key operated control switch unit including an electrical outlet is provided by the present invention which provides a lockable control unit for an electrical circuit to a motor driven tool such as a bench saw, a drill press, planer, or in fact any electrical equipment where safety in the use thereof requires that the operator disable the equipment when he is not using the same. A simple, sturdy, and inexpensive structure is provided for the complete unit, and is construction adapts the unit to any environment for its use.

I claim:

1. A portable electrical outlet-receptacle unit having a safety switch for control of ON and OFF circuit conditions at said outlet-receptacle, comprising in combination:

(a) a molded base member of insulating material having elements for said unit supported, retained in position, and maintained thereon, said base member having an outlet-receptacle with elements therefor at one end portion, an extension cord as an element at the opposite end portion for connection to an electrical source, and a safety switch mechanism having elements intermediate said end portions for closing and opening a circuit from said extension cord electric source to said outlet-receptacle;

(b) said base member having spaced apart upstanding integral portions at said one end portion, with said outlet-receptacle elements comprising a pair of spaced apart contact elements positioned and supported by said upstanding integral portions and having a ground connection element spaced from and below said contact elements and intermediate the position of the same, with said base member having a channel therein for supporting and retaining said ground connection element;

(c) said base member having a recess construction therein at said opposite end portion with said extension cord maintained at said recess construction and said extension cord having multiple conductors therein including a ground conductor electrically connected to said ground connection element and a pair of conductors for electrical connection to corresponding respective stationary contacts, such latter stationary contacts being elements in said switch mechanism;

(d) said base member further having integral upstanding spaced-apart portions substantially centrally thereof having carriage-guiding slots, with said switch mechanism elements including a movable carriage of insulating material having protrusions thereon positioned in said slots to position and maintain said carriage intermediate said upstanding portions and to control longitudinal movement of said carriage in a switching operation, with said movable carriage having therewith a pair of contacts movable in a longitudinal direction upon movement of said carriage to move the same in a longitudinal direction in a path defined by said slots and protrusions, and actuator means operatively connected with said carriage for said longitudinal movement of said carriage;

(e) said base member still further having a recess therein accommodating and maintaining an insert of insulating material with a hump thereon positioned in the movement path of said carriage and said pair of contacts therewith;

(f) said base member likewise having two said corresponding respective stationary contacts positioned and maintained as a pair therein by said base member with each electrically common to a corresponding outlet-receptacle contact, and having two stationary contacts also positioned and maintained therein as a pair by said base member and longitudinally spaced by said insert from said first-named two stationary contacts and respectively electrically common to said pair of conductors in said extension cord, with one pair of said two said stationary contacts extending in one direction from said insert and the other pair of said two stationary contacts extending in the opposite direction from said insert, and with said movable contacts in said carriage completing a circuit from said extension cord to said outlet-receptacle when in engagement with all said four stationary contacts; and (g) a molded cover of insulating material releasably retained on said base member and having inside structure integral with said cover extending into the space between said spaced apart contact elements of said outlet-receptacle and cooperating with said base member in retaining and maintaining said spaced apart contact elements in position on said base member to receive the blades of an electric plug in said outlet-receptacle such that said portable unit acts to provide a controlled electrical circuit therefrom, with said cover having an opening through which said actuator means extends, an opening therein to permit access to said spaced apart contact elements for insertion of the blades of an electric plug, and having a portion for engaging said extension cord to grip and maintain said extension cord at said recess construction with said base member and cover.

2. In a portable electrical outlet-receptacle unit as defined in claim 1 wherein said movable carriage comprises a body portion with a recess on top to receive said actuator means in operative connection therewith and a pair of recesses at the bottom to respectively receive one of said pair of contacts movable with said carriage, said carriage also having integral leg portions extending longitudinally in opposite directions in said body portion, with said leg portions having knobs as said protrusions on said carriage movable in said carriage-guiding slots of said base member, with said integral upstanding spaced-apart portions each having an aperture therein for support of actuator means for moving said carriage.

3. In a portable electrical outlet-receptacle unit as defined in claim 1 wherein each said outlet-receptacle element comprises a U-shaped contact for receiving a blade on an electric plug for providing a usable electrical circuit when said unit is in ON circuit condition, wherein said spaced-apart upstanding integral portions of said base member support and U-shaped contacts for insertion of the blades of a plug therein, and wherein said cover inside structure comprises a projection integral with said molded cover extending into the space between said upstanding integral portions to insulatingly separate said U-shaped contacts upon insertion of said plug blades.

* * * * *